US010156325B2

(12) United States Patent
Koole et al.

(10) Patent No.: US 10,156,325 B2
(45) Date of Patent: Dec. 18, 2018

(54) QUANTUM DOTS IN ENCLOSED ENVIRONMENT

(71) Applicant: KONINKLIJKE PHILIPS N.V., Eindhoven (NL)

(72) Inventors: Roelof Koole, Eindhoven (NL); Dirk Veldman, Eindhoven (NL); Marcel Rene Bohmer, Eindhoven (NL); Kentaro Shimizu, San Jose, CA (US); Loes Johanna Mathilda Koopmans, Eindhoven (NL); Cornelis Eustatius Timmering, Eindhoven (NL)

(73) Assignee: Lumileds LLC, San Jose, CA (US)

( * ) Notice: Subject to any disclaimer, the term of this patent is extended or adjusted under 35 U.S.C. 154(b) by 0 days.

(21) Appl. No.: 15/512,434

(22) PCT Filed: Sep. 16, 2015

(86) PCT No.: PCT/EP2015/071245

§ 371 (c)(1),
(2) Date: Mar. 17, 2017

(87) PCT Pub. No.: WO2016/050517

PCT Pub. Date: Apr. 7, 2016

(65) Prior Publication Data

US 2017/0276300 A1 Sep. 28, 2017

Related U.S. Application Data

(60) Provisional application No. 62/057,334, filed on Sep. 30, 2014.

(30) Foreign Application Priority Data

Oct. 20, 2014 (EP) ..... 14189526

(51) Int. Cl.
*F21K 9/64* (2016.01)
*F21V 9/30* (2018.01)
(Continued)

(52) U.S. Cl.
CPC ..... *F21K 9/64* (2016.08); *F21K 9/23* (2016.08); *F21K 9/232* (2016.08); *F21V 9/30* (2018.02);
(Continued)

(58) Field of Classification Search
CPC ..... F21S 8/10
See application file for complete search history.

(56) References Cited

U.S. PATENT DOCUMENTS

2013/0175920 A1* 7/2013 Hikmet ..... F21V 31/00 313/504
2013/0271955 A1* 10/2013 Van Bommel ..... B82Y 30/00 362/84

FOREIGN PATENT DOCUMENTS

JP 2012009712 A 1/2012
WO 2011053635 A1 5/2011

OTHER PUBLICATIONS

Extended European Search Report dated Apr. 29, 2015, European Application No. 14189526.8, 6 pages.
(Continued)

*Primary Examiner* — Andrew Coughlin

(57) ABSTRACT

The invention provides a lighting device for providing light, the lighting device comprising a closed chamber with a light transmissive window and a light source configured to provide light source radiation into the chamber, wherein the chamber further encloses a wavelength converter configured to convert at least part of the light source radiation into wavelength converter light, wherein the light transmissive window is transmissive for the wavelength converter light,
(Continued)

wherein the wavelength converter comprises luminescent quantum dots which upon excitation with at least part of the light source radiation generate at least part of the wavelength converter light, and wherein the closed chamber comprises a filling gas comprising one or more of helium gas, hydrogen gas, nitrogen gas or oxygen gas, the filling gas having a relative humidity at 19° C. of at least 5%.

25 Claims, 6 Drawing Sheets

(51) Int. Cl.

| | |
|---|---|
| ***F21V 31/00*** | (2006.01) |
| ***F21K 9/23*** | (2016.01) |
| ***F21V 29/70*** | (2015.01) |
| ***F21K 9/232*** | (2016.01) |
| *F21Y 115/10* | (2016.01) |
| *F21Y 101/00* | (2016.01) |

(52) U.S. Cl.
CPC ..... *F21V 29/70* (2015.01); *F21V 31/00* (2013.01); *F21Y 2101/00* (2013.01); *F21Y 2115/10* (2016.08)

(56) References Cited

OTHER PUBLICATIONS

EPO as ISA, "International Search Report and Written Opinion" dated Nov. 26, 2015 from International Application No. PCT/EP2015/071245, filed Sep. 16, 2015, 26 pages.
Koole et al., "On the Incorporation Mechanism of Hydrophobic Quantum Dots in Silica Spheres by a Reverse Microemulsion Method", Chemistry of Materials, vol. 20, No. 7, Apr. 8, 2008, pp. 2503-2512.

* cited by examiner

QUANTUM DOTS IN ENCLOSED ENVIRONMENT

CROSS-REFERENCE TO RELATED APPLICATIONS

The present application is a § 371 application of International Application No. PCT/EP2015/071245 filed on Sep. 16, 2015 and entitled "QUANTUM DOTS IN ENCLOSED ENVIRONMENT," which claims the benefit of U.S. Provisional Patent Application No. 62/057,334 filed on Sep. 30, 2014 and European Patent Application No. 14189526.8 filed on Oct. 20, 2014. International Application No. PCT/EP2015/071245, U.S. Provisional Patent Application No. 62/057,334, and European Patent Application No. 14189526.8 are incorporated herein.

FIELD OF THE INVENTION

The invention relates to a lighting device including luminescent nanoparticles. The invention further relates to the production process of such lighting device.

BACKGROUND OF THE INVENTION

The sealing of luminescent nanocrystals in lighting devices is known in the art. WO2011/053635, for instance, describes a light-emitting diode (LED) device, comprising: (a) a blue-light emitting LED; and (b) a hermetically sealed container comprising a plurality of luminescent nanocrystals, wherein the container is placed with respect to the LED to facilitate down-conversion of the luminescent nanocrystals. Examples of the luminescent nanocrystals include core/shell luminescent nanocrystals comprising CdSe/ZnS, InP/ZnS, PbSe/PbS, CdSe/CdS, CdTe/CdS or CdTe/ZnS. For instance, the luminescent nanocrystals are dispersed in a polymeric matrix.

JP2012009712 describes a light emitting device comprising a semiconductor laser emitting laser light and a light emitting part receiving excitation light emitted from the semiconductor laser and emitting light. The semiconductor laser and the light emitting part are provided in an airtight space, and dry air having a moisture content not more than a predetermined moisture content is filled in the airtight space.

SUMMARY OF THE INVENTION

Quantum dots (qdots or QDs) are currently being studied as phosphors in solid state lighting (SSL) applications (LEDs). They have several advantages such as a tunable emission and a narrow emission band which can help to significantly increase the efficacy of LED based lamps, especially at high CRI. Typically, qdots are supplied in an organic liquid, with the quantum dots surrounded by organic ligands, such as oleate (the anion of oleic acid), which helps to improve the emission efficiency of the dots as well as stabilize them in organic media. The synthesis of silica coatings on quantum dots is known in the art. Koole et al. (in R. Koole, M. van Schooneveld, J. Hilhorst, C. de Mello Donegá, D. 't Hart, A. van Blaaderen, D. Vanmaekelbergh and A. Meijerink, Chem. Mater, 20, p. 2503-2512, 2008) describes experimental evidence in favor of a proposed incorporation mechanism of hydrophobic semiconductor nanocrystals (or quantum dots, QDs) in monodisperse silica spheres (diameter ~35 nm) by a water-in-oil (W/O) reverse microemulsion synthesis. Fluorescence spectroscopy is used to investigate the rapid ligand exchange that takes place at the QD surface upon addition of the various synthesis reactants. It was found that hydrolyzed TEOS has a high affinity for the QD surface and replaces the hydrophobic amine ligands, which enables the transfer of the QDs to the hydrophilic interior of the micelles where silica growth takes place. By hindering the ligand exchange using stronger binding thiol ligands, the position of the incorporated QDs could be controlled from centered to off-center and eventually to the surface of the silica spheres. They were able to make QD/silica particles with an unprecedented quantum efficiency of 35%. Silica encapsulation of QDs, see also above, is (thus) used to stabilize the QDs in air and to protect them from chemical interactions with the outside. The reverse micelle method was introduced in the 90's as a method to make small (~20 nm) silica particles with a small size dispersion (see below). This method can also be used to make silica-coated QDs. The native organic ligands around QDs are replaced by inorganic silica precursor molecules during the silica shell growth. The inorganic silica shell around QDs has the promise to make QDs more stable against photo-oxidation, because the organic ligands are seen as the weak chain in conventional (e.g. oleic acid or hexadecylamine) capped QDs.

However, silica as grown by the reverse micelle method appears to be relatively porous, making it a less good barrier against oxygen or water than sometimes suggested. For QDs with organic ligands the stability in ambient conditions is less than in general desired, and it was found that especially water is the root cause for degradation of such QDs. This may lead to quantum dot based lighting devices which have a quantum efficiency (QE) stability and/or color point stability over time which are less than desirable. For instance, a large initial QE drop may be percieved, or a photo brightening effect may be percieved, and/or a color point change during life time may be percieved.

Hence, it is an aspect of the invention to provide an alternative lighting device, which preferably further at least partly obviates one or more of above-described drawbacks.

It was surprisingly observed that silica coated QDs require a certain amount of water to ensure optimal performance (both QE and stability). Especially when QDs are used within a hermetically sealed light bulb, it surprisingly appears that it is important to include a sufficient amount of water. A specific example of such an application is a helium cooled LED bulb, where a number of LEDs are placed in a hermetically sealed glass bulb (using the process used for conventional incandescent light bulbs) under a helium atmosphere. Because of the unique cooling properties of helium, limited additional heat sinking is required in such a lamp architecture, saving significant costs. However, when QDs are used in such a closed, water-free environment, it is seen that the overall performance is worse than in ambient, and increased initial quenching and photo brightening effects are observed. It was surprisingly found that adding a significant relative humidity (at room temperature) to the sealed environment in which QDs are enclosed (e.g. a He or He/$O_2$ filled light bulb) prevents especially initial quenching and photobrightening effects.

Hence, in a first aspect the invention provides a lighting device comprising a closed chamber with a light transmissive window and a light source configured to provide light source radiation into the chamber, wherein the chamber further encloses a wavelength converter configured to convert at least part of the light source radiation into wavelength converter light, wherein the light transmissive window is transmissive for the wavelength converter light, wherein the wavelength converter comprises luminescent quantum dots which upon excitation with at least part of the light source radiation generate at least part of said wavelength converter light, and wherein the closed chamber comprises a filling gas, especially comprising one or more of helium gas, hydrogen gas ($H_2$), nitrogen gas ($N_2$) and oxygen gas ($O_2$), and (the filling gas) especially having a relative humidity (RH) at 19° C. of at least 1%, such as especially at least 5%, but especially lower than 100% (at 19° C.), such as in the range of 5-95%, like 10-85%. It appears that such device may have a substantially more stable color point than a device with other gas conditions, such as a water-free gas. Further, it appears that such device may suffer substantially less from an initial QE drop and/or from photo brightening effects of the QDs.

The filling gas especially has a relative high thermal conductivity, such as the indicated helium, hydrogen, nitrogen and oxygen gas, even more especially at least one or more of helium and hydrogen. Hence, the filling gas may also be applied as cooling gas (optionally in combination with a heat sink (see also below)). Further, especially the filling gas is relative inert, such as helium, hydrogen and nitrogen, even more especially helium and nitrogen. Hence, the filling gas may especially comprise helium.

Gas fillings herein are defined as gas (composition) without $H_2O$. The presence of $H_2O$ is indicated by the relative humidity of the gas (composition), i.e. gas filling.

The closed chamber with a light transmissive window is configured to host the wavelength converter. The wavelength converter is thus especially enclosed by the closed chamber. To this end, the chamber may comprise a wall, the wall providing said closed chamber. The term "wall" may also refer to a plurality of walls and may optionally comprise more than one element. For instance, part of the wall may be provided by an element or support comprising the light source and e.g. electronics and a heat sink, and may e.g. include also a PCB (printed circuit board). Hence, the light source may also be enclosed by the chamber. However, the light source may also be external from the chamber. Further, it may also be possible that part of the light source is outside of the chamber and part of the light source, especially a light emissive surface, may be within the chamber. When the light source is configured outside the chamber, or when the light emissive surface of such light source is configured outside the chamber, the light source will be configured to provide light source radiation into the chamber via a radiation transmissive window. Hence, in such instance the chamber may include a radiation transmissive window that is transmissive for at least part of the light source radiation.

The wall(s) of the chamber are especially gas tight, i.e. that substantially no gas leaks away from the chamber or is introduced from external of the chamber into the chamber after closing the chamber. Hence, the wall(s), including the light transmissive window (and optionally the radiation transmissive window) is especially gas-tight. The gas chamber may thus especially hermitically sealed. In an embodiment, the wall(s) may e.g. include inorganic material. In yet another embodiment, the wall(s) may include an organic material, e.g. covered with a layer of an (e.g. inorganic) gas-tight material. Combinations of inorganic wall parts and organic wall parts may also be possible.

Optionally, the lighting device further comprises a heat sink in thermal contact with one or more of the transmissive window, the light source and the wavelength converter. Together with the filling gas, this may provide a good thermal control and will reduce operating temperature. The term "thermal" contact may in an embodiment mean physical contact and may in another embodiment mean in contact via a (solid) thermal conductor.

Especially, the light source is a light source that during operation emits (light source radiation) at least light at a wavelength selected from the range of 200-490 nm, especially a light source that during operation emits at least light at wavelength selected from the range of 400-490 nm, even more especially in the range of 440-490 nm. This light may partially be used by the wavelength converter nanoparticles (see further also below). Hence, in a specific embodiment, the light source is configured to generate blue light. In a specific embodiment, the light source comprises a solid state LED light source (such as a LED or laser diode). The term "light source" may also relate to a plurality of light sources, such as 2-20 (solid state) LED light sources. Hence, the term LED may also refer to a plurality of LEDs.

As indicated above, the light source is configured to provide light source radiation into the chamber, which chamber comprises the wavelength converter. The wavelength converter is configured to convert at least part of the light source radiation into wavelength converter light. Hence, the wavelength converter is radiationally coupled to the light source. The term "radiationally coupled" especially means that the light source and the wavelength converter are associated with each other so that at least part of the radiation emitted by the light source is received by the wavelength converter (and at least partly converted into luminescence).

At least part of the wavelength converter light is visible light, such as green, yellow, orange and/or red light. The wavelength converter "wavelength converts" the light source radiation into wavelength converter light. The wavelength converter at least comprises quantum dots. However, the wavelength converter may also include one or more other luminescent materials, herein also indicated as second luminescent material. Such second luminescent material may (thus) optionally also be embedded in the wavelength converter. However, such second luminescent material may also be arranged elsewhere in the closed chamber (or optionally also outside the chamber).

Hence, the wavelength converter may include one or more luminescent materials, but at least comprises quantum dots. These quantum dots are responsible for at least part of the wavelength converter light. Hence, the luminescent quantum dots are configured to generate at least part of the wavelength converter light upon excitation with at least part of the light source radiation. The luminescence of the wavelength converter should escape from the chamber. Hence, the chamber comprises a light transmissive window. The light transmissive window comprises a solid material that is transmissive for at least part of the visible light generated by the wavelength converter. When the light source is configured external from the chamber, the radiation transmissive window may comprise the light transmissive window. However, optionally these are different parts from of the chamber (wall).

Hence, the device is especially configured to generate lighting device light, which at least partly comprises the wavelength converter light, but which may optionally also comprise (remaining) light source radiation. For instance, the wavelength converter may be configured to only partly convert the light source radiation. In such instance, the device light may comprise converter light and light source radiation. However, in another embodiment the wavelength converter may also be configured to convert all the light source radiation.

Hence, in a specific embodiment, the lighting device is configured to provide lighting device light comprising both light source radiation and converter light, for instance the former being blue light, and the latter comprising yellow light, or yellow and red light, or green and red light, or green, yellow and red light, etc. In yet another specific embodiment, the lighting device is configured to provide lighting device light comprising only converter light. This may for instance happen (especially in transmissive mode) when light source radiation irradiating the wavelength converter only leaves the downstream side of the wavelength converter as converted light (i.e. all light source radiation penetrating into the wavelength converter is absorbed by the wavelength converter).

The term "wavelength converter" may also relate to a plurality of wavelength converters. These can be arranged downstream of one another, but may also be arranged adjacent to each other (optionally also even in physical contact as directly neighboring wavelength converters). The plurality of wavelength converters may comprise in an embodiment two or more subsets which have different optical properties. For instance, one or more subsets may be configured to generate wavelength converter light with a first spectral light distribution, like green light, and one or more subsets may be configured to generate wavelength converter light with a second spectral light distribution, like red light. More than two or more subsets may be applied. When applying different subsets having different optical properties, e.g. white light may be provided and/or the color of the device light (i.e. the converter light and optional remaining light source radiation (remaining downstream of the wavelength converter)). Especially when a plurality of light sources is applied, of which two or more subsets may be individually controlled, which are radiationally coupled with the two or more wavelength converter subsets with different optical properties, the color of the device light may be tunable. Other options to make white light are also possible (see also below). When the lighting device comprises a plurality of light source, then these may optionally be controlled independently (with an (external) control unit).

The second luminescent material, as indicated above, may comprise one or more luminescent materials selected from the group consisting of a divalent europium containing nitride luminescent material or a divalent europium containing oxonitride luminescent material, such as one or more materials selected from the group consisting of (Ba,Sr,Ca)S:Eu, $(Mg,Sr,Ca)AlSiN_3$:Eu and $(Ba,Sr,Ca)_2Si_5N_8$:Eu.

The second luminescent material may also comprise one or more luminescent materials selected from the group consisting of a trivalent cerium containing garnet and a trivalent cerium containing oxonitride. The oxonitride materials are in the art often also indicated as oxonitride materials. Such cerium containing garnet may be indicated with the general formula $A_3B_5O_{12}:Ce^{3+}$, wherein A may comprise one or more of Y, Sc, La, Gd, Tb and Lighting unit, and wherein B comprises one or more of Al and Ga. Especially, A comprises one or more of Y, Gd and Ly, and B comprises one or more of Al and Ga, especially at least (or only) Al. Hence, the cerium containing garnet may especially comprise $(Y,Gd,Lu)_3(Al,Ga)_5O_{12}:Ce^{3+}$ class). Examples of members within this class are $Y_3Al_5O_{12}:Ce^{3+}$ and $Lu_3Al_5O_{12}:Ce^{3+}$, etc.

The second luminescent material may also comprise a tetravalent manganese doped material. Especially, members of the $G_2ZF_6$:Mn class may be relevant, wherein G is selected from the group of alkaline elements (such as Li, Na, K, etc.) and wherein Z is selected from the group of Si, Ge, Ti, Hf, Zr, Sn. This class is herein also indicated as the $K_2SiF_6$:Mn class, which is the class of complex fluoride systems. The materials within this class have a cubic Hieratite or hexagonal Demartinite type crystal structure. An example of a member within this class is $K_2SiF_6$:Mn (IV; i.e. tetravalent manganese).

The second luminescent material may also comprise an organic luminescent material, such as a perylene derivative.

The term "class" or "group" herein especially refers to a group of materials that have the same crystallographic structure. Further, the term "class" may also include partial substitutions of cations and/or anions. For instance, in some of the above-mentioned classes Al—O may partially be replaced by Si—N (or the other way around).

Further, the fact that the above indicated luminescent materials are indicated to be doped with europium (Eu), or cerium (Ce), or manganese (Mn) does not exclude the presence of co-dopants, such the Eu,Ce, wherein europium is co-doped with cerium, Ce,Pr, wherein cerium is codoped with praseodymium, Ce,Na, wherein cerium is codoped with sodium, Ce,Mg, wherein cerium is codoped with magnesium, Ce,Ca, wherein cerium is codoped with calcium, etc., etc. Codoping is known in the art and is known to sometimes enhance the quantum efficiency and/or to tune the emission spectrum.

In an embodiment, the light transmissive window (and/or optionally also the radiation transmissive window) may comprises one or more materials selected from the group consisting of a transmissive organic material support, such as selected from the group consisting of PE (polyethylene), PP (polypropylene), PEN (polyethylene napthalate), PC (polycarbonate), polymethylacrylate (PMA), polymethylmethacrylate (PMMA) (Plexiglas or Perspex), cellulose acetate butyrate (CAB), silicone, polyvinylchloride (PVC), polyethylene terephthalate (PET), (PETG) (glycol modified polyethylene terephthalate), PDMS (polydimethylsiloxane), and COC (cyclo olefin copolymer). However, in another embodiment the light transmissive window (and/or optionally also the radiation transmissive window) may comprise an inorganic material. Preferred inorganic materials are selected from the group consisting of glasses, (fused) quartz, transmissive ceramic materials, and silicones. Also hybrid materials, comprising both inorganic and organic parts may be applied. Especially preferred are PMMA, transparent PC, or glass as material for the light transmissive window (and/or optionally also the radiation transmissive window).

The light transmissive window (and/or optionally also the radiation transmissive window) may be substantially transparent but may alternatively (independently) be selected to be translucent. For instance, material may be embedded in the window to increase translucency and/or the window may be frosted (such as with sand blasting) (see further also below). By providing a translucent light transmissive window the elements within the chamber may be less or may be not visible, which may be desirable. Hence, for the light transmissive window and the option radiation transmissive window light (radiation) transmissive material is applied. Especially, the material has a light transmission in the range of 50-100%, especially in the range of 70-100%, for light generated by the luminescent material, i.e. especially the luminescent quantum dots, and having a wavelength selected from the visible wavelength range. In this way, the support cover is transmissive for visible light from the luminescent material. The transmission or light permeability can be determined by providing light at a specific wavelength with a first intensity to the material and relating the intensity of the light at that wavelength measured after transmission through the material, to the first intensity of the light provided at that specific wavelength to the material (see also E-208 and E-406 of the CRC Handbook of Chemistry and Physics, 69th edition, 1088-1989).

In a specific embodiment, the closed chamber comprises a light bulb shaped light transmissive window. In this way, a kind of retrofit incandescent lamp can be provided. However, other retrofit type chambers may also be applied, like tubular chambers (T-lamps, such as a T8 tube), etc. However, the chamber may also be formed in other shapes and may also be used to replace an existing lighting fixture.

As indicated above, the chamber comprises a filling gas comprising one or more of helium gas, hydrogen gas, nitrogen gas and oxygen gas and having a relative humidity at 19° C. of at least 1%, such as especially at least 5%, but especially lower than 100%, such as in the range of 5-95%, like 10-85% (at 19° C.). The upper range is especially lower than 100%, such that when the light source is used at a temperature lower than 19° C., there is (substantially) no condensation of water. Hence, especially the relative humidity at 19° C. is 95% or lower, such a 90% or lower, like 85% or lower, such as at maximum 80%. The lower limit of 1% is especially chosen to provide the desired stability effect (see also above). Especially a lower limit of at least 5% relative humidity may provide the desired stability effect. For a determination of the relative humidity in the chamber the Karl Fischer analysis may be applied, which is known in the art. This analysis is also known as Karl Fisch titration. The relative humidity is a ratio, expressed in percent, of the amount of $H_2O$ present in a gas (the partial pressure of water vapor) relative to the amount that would be present if the gas were saturated (the equilibrium vapor pressure of water).

Hence, it appears that helium as atmosphere, and/or optionally one or more other high thermal conductivity gas(ses), for the quantum dots is beneficial. Especially the helium gas and/or other gasses are used for cooling. Cooling is important for LED efficiency. Especially also for QD-based LEDs, a lower temperature will in general mean longer stability (lifetime) and higher lm/W efficiency (due to higher QE). However, surprisingly the presence of some $H_2O$ is further beneficial. In a specific embodiment at least 70% (not including $H_2O$), such as especially at least 75%, such as at least 80%, of the filling gas consists of He. The percentage refers to volume percentages. Further, the presence of some oxygen may surprisingly also be beneficial. Hence, would in the past solutions be sought that try to seal as good as possible the quantum dots from water and oxygen, in the present invention deliberately some water, and optionally also some oxygen, is provided into the chamber wherein the quantum dots are arranged. In yet a further embodiment, the filling gas comprises (at least) helium and oxygen. In a specific embodiment, at least 95%, such as at least 99% of the filling gas (not taking into account $H_2O$) consists of He and $O_2$, and wherein the gas comprises at maximum 30% oxygen, such as at maximum 25% oxygen, like at maximum 20% oxygen. Larger amounts of oxygen may be less desirable in view of amongst others thermal energy management and also stability of the lighting device. Other gasses that may be available may be selected from the (other) noble gasses, $H_2$ and $N_2$, especially $H_2$ and $N_2$. As indicated above, the RH is at least 1%, even more at least 5%, such as at least 10%. Especially, at 19° C. the chamber does not contain liquid water.

The quantum dots may optionally also be embedded in a matrix. For instance, the quantum dots may be (homogeneously) dispersed in a (polymeric) matrix. Matrices of specific interest are siloxanes (which are often also indicated as silicones). When combining a siloxane starting material and the QD a siloxane may be obtained with known siloxane production processes wherein the quantum dots are dispersed. Hence, in a specific embodiment the wavelength converter comprises a siloxane matrix wherein the luminescent quantum dots are embedded. Relevant siloxane matrices comprise e.g. one or more of polydimethylsiloxane (PDMS) and polydiphenylsiloxane (PDPhS). However, also other matrices may be applied, such as one or more of a silazane and an acrylate. Even though the QDs are embedded in a matrix it appears that the gas conditions as defined herein are beneficial for the light device (especially QD) properties. Such matrices may not be completely impermeable for water. Hence, even when the QDs are embedded in a (silicone) matrix, the filling gas as indicated above is desirable.

Quantum dots may be provided as bare particles, or may e.g. be provided as core-shell particles. The term "shell" may also refer to a plurality of shells. Further, core-shell particles are not necessarily spherical; they may e.g. also be of the quantum rod type or tetrapod type (or other multipod type), etc. Further examples are provided below. The bare particle or core is the optically active part. The shell is used as a kind of protection and often comprises a similar type of material, such as a ZnSe core and a ZnS shell (see also below). Such particles are commercially available in organic liquids, with organic ligands attached to such particles for better dispersion. Herein, the outer layer of the particle is the layer most remote from a central part of the bare particle or the core. In the case of a ZnS shell, this outer layer would be the ZnS surface of the QD. The invention is, however, not limited to quantum dots whit a ZnS shell and a ZnSe core. Below, a number of alternative quantum dots are described.

On such outer layer, a (silica) coating may be provided, thereby providing a bare quantum dot with a (silica) coating or a core-shell quantum dot with a (silica) coating. Coating quantum dots with silica results in replacement of the organic ligands by silica precursor molecules, which may act as more stable inorganic ligands. In addition, the silica layer may form a protective barrier against e.g. photo-oxidative species. Especially, the coating entirely covers the outer layer. Suitable methods to provide silica coatings around QDs are amongst others described by Koole et al. (see above), and references cited therein. The synthesis of silica particles without nanoparticles enclosed was first developed by Stober et al (J. Colloid Interface Sci. 1968, 62), which allows the growth of silica spheres of uniform size and shape in e.g. an ethanol phase. The second method of making silica spheres uses micelles in an apolar phase and is called the reverse micelle method (or reverse micro emulsion method), and was first suggested by Osseo-Asare, J. Colloids. Surf 1990, 6739). The silica particles are grown in defined water droplets, which results in a uniform size distribution which can be controlled quite easily. This approach was extended by introducing nanoparticles in the silica. The main advantage of this approach compared to the Stober method, is that both hydrophobic and hydrophilic particles can be coated, no ligand exchange on forehand is required and there is more control over the particles size and size dispersion.

The present invention is not limited to one of these methods. However, in a specific embodiment the coating process is executed in micelles containing said quantum dots, especially using the reverse-micelle method, as also discussed in Koole et al., which is herein incorporated by reference. Hence, the coating process is especially a process wherein the coating, especially an oxide coating, even more especially a silica coating, is provided to the outer layer of the QD, and which coating process is especially performed in micelles, wherein the QD is enclosed. A micelle may especially be defined as an aggregate of surfactant molecules dispersed in a liquid medium. A typical micelle in aqueous solution forms an aggregate with the hydrophilic "head" regions in contact with surrounding solvent, sequestering the hydrophobic single-tail regions in the micelle center. A reverse micelle is the other way around, using an apolar solution and where the hydrophilic "heads" are pointing inwards and the hydrophobic tail regions are in contact with the apolar medium. Hence, the quantum dots may also comprise coated quantum dots, such as e.g. core-shell QDs comprising a silica coating. Especially, the coating comprises a silica ($SiO_2$) coating. Alternatively or additionally, the coating may comprise a titania ($TiO_2$) coating, an alumina ($Al_2O_3$) coating, or a zirconia ($ZrO_2$) coating. The coating is especially provided in a wet-chemical approach. Further, the coating is especially an inorganic coating. Hence, in an embodiment the luminescent quantum dots comprise an inorganic coating.

Even though the QDs are coated it appears that the gas conditions as defined herein are beneficial for the light device (especially QD) properties. Also such coatings, especially obtainable via a wet-chemical process, may not be completely impermeable for water. Hence, even when the QDs are coated, the filling gas as indicated above is desirable.

Hence, in yet a more specific embodiment of the lighting device, the luminescent quantum dots comprise an inorganic coating, wherein the wavelength converter comprises a (siloxane) matrix wherein the luminescent quantum dots, with said inorganic coating, are embedded.

The quantum dots or luminescent nanoparticles, which are herein indicated as wavelength converter nanoparticles, may for instance comprise group II-VI compound semiconductor quantum dots selected from the group consisting of CdS, CdSe, CdTe, ZnS, ZnSe, ZnTe, HgS, HgSe, HgTe, CdSeS, CdSeTe, CdSTe, ZnSeS, ZnSeTe, ZnSTe, HgSeS, HgSeTe, HgSTe, CdZnS, CdZnSe, CdZnTe, CdHgS, CdHgSe, CdHgTe, HgZnS, HgZnSe, HgZnTe, CdZnSeS, CdZnSeTe, CdZnSTe, CdHgSeS, CdHgSeTe, CdHgSTe, HgZnSeS, HgZnSeTe and HgZnSTe. In another embodiment, the luminescent nanoparticles may for instance be group III-V compound semiconductor quantum dots selected from the group consisting of GaN, GaP, GaAs, AlN, AlP, AlAs, InN, InP, InAs, GaNP, GaNAs, GaPAs, AlNP, AlNAs, AlPAs, InNP, InNAs, InPAs, GaAlNP, GaAlNAs, GaAlPAs, GaInNP, GaInNAs, GaInPAs, InAlNP, InAlNAs, and InAlPAs. In yet a further embodiment, the luminescent nanoparticles may for instance be I-III-VI2 chalcopyrite-type semiconductor quantum dots selected from the group consisting of $CuInS_2$, $CuInSe_2$, $CuGaS_2$, $CuGaSe_2$, $AgInS_2$, $AgInSe_2$, $AgGaS_2$, and $AgGaSe_2$. In yet a further embodiment, the luminescent nanoparticles may for instance be I-V-VI2 semiconductor quantum dots, such as selected from the group consisting of $LiAsSe_2$, $NaAsSe_2$ and $KAsSe_2$. In yet a further embodiment, the luminescent nanoparticles may for instance be a group IV-VI compound semiconductor nano crystals such as SbTe. In a specific embodiment, the luminescent nanoparticles are selected from the group consisting of InP, $CuInS_2$, $CuInSe_2$, CdTe, CdSe, CdSeTe, $AgInS_2$ and $AgInSe_2$. In yet a further embodiment, the luminescent nanoparticles may for instance be one of the group II-VI, III-V, I-III-V and IV-VI compound semiconductor nano crystals selected from the materials described above with inside dopants such as ZnSe:Mn, ZnS:Mn. The dopant elements could be selected from Mn, Ag, Zn, Eu, S, P, Cu, Ce, Tb, Au, Pb, Tb, Sb, Sn and Tl. Herein, the luminescent nanoparticles based luminescent material may also comprise different types of QDs, such as CdSe and ZnSe:Mn.

It appears to be especially advantageous to use II-VI quantum dots. Hence, in an embodiment the semiconductor based luminescent quantum dots comprise II-VI quantum dots, especially selected from the group consisting of CdS, CdSe, CdTe, ZnS, ZnSe, ZnTe, HgS, HgSe, HgTe, CdSeS, CdSeTe, CdSTe, ZnSeS, ZnSeTe, ZnSTe, HgSeS, HgSeTe, HgSTe, CdZnS, CdZnSe, CdZnTe, CdHgS, CdHgSe, CdHgTe, HgZnS, HgZnSe, HgZnTe, CdZnSeS, CdZnSeTe, CdZnSTe, CdHgSeS, CdHgSeTe, CdHgSTe, HgZnSeS, HgZnSeTe and HgZnSTe, even more especially selected from the group consisting of CdS, CdSe, CdSe/CdS and CdSe/CdS/ZnS. In an embodiment, however, Cd-free QDs are applied. In a specific embodiment, the wavelength converter nano-particles comprise III-V QDs, more specifically an InP based quantum dots, such as a core-shell InP—ZnS QDs. Note that the terms "InP quantum dot" or "InP based quantum dot" and similar terms may relate to "bare" InP QDs, but also to core-shell InP QDs, with a shell on the InP core, such as a core-shell InP—ZnS QDs, like a InP—ZnS QDs dot-in-rod.

The luminescent nanoparticles (without coating) may have dimensions in the range of about 1-50 nm, especially 1-20 nm, such as 1-15 nm, like 1-5 nm; especially at least 90% of the nanoparticles have dimension in the indicated ranges, respectively, (i.e. e.g. at least 90% of the nanoparticles have dimensions in the range of 2-50 nm, or especially at least 90% of the nanoparticles have dimensions in the range of 5-15 nm). The term "dimensions" especially relate to one or more of length, width, and diameter, dependent upon the shape of the nanoparticle. In an embodiments, the wavelength converter nanoparticles have an average particle size in a range from about 1 to about 1000 nanometers (nm), and preferably in a range from about 1 to about 100 nm. In an embodiment, nanoparticles have an average particle size in a range from about 1-50 nm, especially 1 to about 20 nm, and in general at least 1.5 nm, such as at least 2 nm. In an embodiment, nanoparticles have an average particle size in a range from about 1 to about 20 nm.

Typical dots may be made of binary alloys such as cadmium selenide, cadmium sulfide, indium arsenide, and indium phosphide. However, dots may also be made from ternary alloys such as cadmium selenide sulfide. These quantum dots can contain as few as 100 to 100,000 atoms within the quantum dot volume, with a diameter of 10 to 50 atoms. This corresponds to about 2 to 10 nanometers. For instance, (spherical) particles such as CdSe, InP, or $CuInSe_2$, with a diameter of about 3 nm may be provided. The luminescent nanoparticles (without coating) may have the shape of spherical, cube, rods, wires, disk, multi-pods, etc., with the size in one dimension of less than 10 nm. For instance, nanorods of CdSe with the length of 20 nm and a diameter of 4 nm may be provided. Hence, in an embodiment the semiconductor based luminescent quantum dots comprise core-shell quantum dots. In yet another embodiment, the semiconductor based luminescent quantum dots comprise dots-in-rods nanoparticles. A combination of different types of particles may also be applied. For instance, core-shell particles and dots-in-rods may be applied and/or combinations of two or more of the afore-mentioned nano particles may be applied, such as CdS and CdSe. Here, the term "different types" may relate to different geometries as well as to different types of semiconductor luminescent material. Hence, a combination of two or more of (the above indicated) quantum dots or luminescent nano-particles may also be applied. Hence, in an embodiment the quantum dots have a shape selected from the group consisting of a sphere, a cube, a rod, a wire, a disk, and a multi-pod, etc. A combination of different types of particles may also be applied. Here, the term "different types" may relate to different geometries as well as to different types of semiconductor luminescent material. Hence, a combination of two or more of (the above indicated) quantum dots or luminescent nano-particles may also be applied.

In an embodiment, nanoparticles or QDs can comprise semiconductor nanocrystals including a core comprising a first semiconductor material and a shell comprising a second semiconductor material, wherein the shell is disposed over at least a portion of a surface of the core. A semiconductor nanocrystal or QD including a core and shell is also referred to as a "core/shell" semiconductor nanocrystal.

For example, the semiconductor nanocrystal or QD can include a core having the formula MX, where M can be cadmium, zinc, magnesium, mercury, aluminum, gallium, indium, thallium, or mixtures thereof, and X can be oxygen, sulfur, selenium, tellurium, nitrogen, phosphorus, arsenic, antimony, or mixtures thereof. Examples of materials suitable for use as semiconductor nanocrystal cores include, but are not limited to, ZnO, ZnS, ZnSe, ZnTe, CdO, CdS, CdSe, CdTe, MgS, MgSe, GaAs, GaN, GaP, GaSe, GaSb, HgO, HgS, HgSe, HgTe, InAs, InN, InP, InSb, AlAs, AlN, AlP, AlSb, TlN, TlP, TlAs, TlSb, PbO, PbS, PbSe, PbTe, Ge, Si, an alloy including any of the foregoing, and/or a mixture including any of the foregoing, including ternary and quaternary mixtures or alloys.

The shell can be a semiconductor material having a composition that is the same as or different from the composition of the core. The shell comprises an overcoat of a semiconductor material on a surface of the core semiconductor nanocrystal can include a Group IV element, a Group II-VI compound, a Group II-V compound, a Group III-VI compound, a Group III-V compound, a Group IV-VI compound, a Group I-III-VI compound, a Group II-IV-VI compound, a Group II-IV-V compound, alloys including any of the foregoing, and/or mixtures including any of the foregoing, including ternary and quaternary mixtures or alloys. Examples include, but are not limited to, ZnO, ZnS, ZnSe, ZnTe, CdO, CdS, CdSe, CdTe, MgS, MgSe, GaAs, GaN, GaP, GaSe, GaSb, HgO, HgS, HgSe, HgTe, InAs, InN, InP, InSb, AlAs, AlN, AlP, AlSb, TlN, TlP, TlAs, TlSb, PbO, PbS, PbSe, PbTe, Ge, Si, an alloy including any of the foregoing, and/or a mixture including any of the foregoing. For example, ZnS, ZnSe or CdS overcoatings can be grown on CdSe or CdTe semiconductor nanocrystals. An overcoating process is described, for example, in U.S. Pat. No. 6,322,901. By adjusting the temperature of the reaction mixture during overcoating and monitoring the absorption spectrum of the core, over coated materials having high emission quantum efficiencies and narrow size distributions can be obtained. The overcoating may comprise one or more layers. The overcoating comprises at least one semiconductor material which is the same as or different from the composition of the core. Preferably, the overcoating has a thickness from about one to about ten monolayers. An overcoating can also have a thickness greater than ten monolayers. In an embodiment, more than one overcoating can be included on a core.

In an embodiment, the surrounding "shell" material can have a band gap greater than the band gap of the core material. In certain other embodiments, the surrounding shell material can have a band gap less than the band gap of the core material. In an embodiment, the shell can be chosen so as to have an atomic spacing close to that of the "core" substrate. In certain other embodiments, the shell and core materials can have the same crystal structure. Examples of semiconductor nanocrystal (core)shell materials include, without limitation: red (e.g., (CdSe)ZnS (core)shell), green (e.g., (CdZnSe)CdZnS (core)shell, etc.), and blue (e.g., (CdS)CdZnS (core)shell (see further also above for examples of specific wavelength converter nanoparticles, based on semiconductors. Herein, the terms "semiconductor nanocrystal" and "QD" are used interchangeably. Another term for quantum dots is luminescent nanocrystal.

Hence, the above-mentioned outer surface may be the surface of a bare quantum dot (i.e. a QD not comprising a further shell or coating) or may be the surface of a coated quantum dot, such as a core-shell quantum dot (like core-shell or dot-in-rod), i.e. the (outer) surface of the shell. The grafting ligand thus especially grafts to the outer surface of the quantum dot, such as the outer surface of a dot-in-rod QD.

Therefore, in a specific embodiment, the wavelength converter nanoparticles are selected from the group consisting of core-shell nano particles, with the cores and shells comprising one or more of CdS, CdSe, CdTe, ZnS, ZnSe, ZnTe, HgS, HgSe, HgTe, CdSeS, CdSeTe, CdSTe, ZnSeS, ZnSeTe, ZnSTe, HgSeS, HgSeTe, HgSTe, CdZnS, CdZnSe, CdZnTe, CdHgS, CdHgSe, CdHgTe, HgZnS, HgZnSe, HgZnTe, CdZnSeS, CdZnSeTe, CdZnSTe, CdHgSeS, CdHgSeTe, CdHgSTe, HgZnSeS, HgZnSeTe, HgZnSTe, GaN, GaP, GaAs, AlN, AlP, AlAs, InN, InP, InAs, GaNP, GaNAs, GaPAs, AlNP, AlNAs, AlPAs, InNP, InNAs, InPAs, GaAlNP, GaAlNAs, GaAlPAs, GaInNP, GaInNAs, GaInPAs, InAlNP, InAlNAs, and InAlPAs. In general, the cores and shells comprise the same class of material, but essentially consist of different materials, like a ZnS shell surrounding a CdSe core, etc. In an embodiment, the quantum dots comprise core/shell luminescent nanocrystals comprising CdSe/ZnS, InP/ZnS, PbSe/PbS, CdSe/CdS, CdTe/CdS or CdTe/ZnS.

The lighting device as described above may be obtainable in different ways. For instance, part of the processing may be done in the indicated filling gas, thereby allowing the chamber to be filled with the filling gas followed by a closing of the chamber with a closure. In another embodiment, the lighting device may substantially be assembled, but the chamber may include a gas stem for filling the chamber with the filling gas. After filling the chamber, the gas stem may be closed with a closure. In yet another embodiment, which may be combined with one or more of the former embodiments, part of the gas atmosphere may be provided by a material in the (closed) chamber that releases one or more of the components.

Hence, in a further aspect the invention also provides a process for the production of the lighting device comprising a closed chamber with a light transmissive window and a light source configured to provide light source radiation into the chamber, wherein the chamber further encloses a wavelength converter configured to convert at least part of the light source radiation into wavelength converter light, wherein the light transmissive window is transmissive for the wavelength converter light, wherein the wavelength converter comprises luminescent quantum dots which upon excitation with at least part of the light source radiation generate at least part of said wavelength converter light, and wherein the closed chamber comprises a filling gas comprising one or more of helium gas, hydrogen gas, nitrogen gas and oxygen gas and gaseous water at 19° C., the process comprising assembling in an assembling process the chamber with a light transmissive window, the light source and the wavelength converter, wherein the filling gas (comprising one or more of helium gas, hydrogen gas, nitrogen gas and oxygen gas) and water is provided to said chamber. After providing the filling gas (and water (gas)) to the chamber, the chamber may be closed (such as by hermetically sealing).

Herein, the phrase "filling gas (especially) comprising one or more of helium gas, hydrogen gas, nitrogen gas and oxygen gas and gaseous water at 19° C." and similar phrases does not mean that the filling gas is provided to the chamber at this temperature. In contrast, the gasses may be provided separately, the $H_2O$ may be provided as water, etc. However, the filling gas is such that when the chamber is closed and the filling gas is in the chamber, at 19° C. the filling gas comprises helium and/or one or more of the other gasses, and gaseous water. Further, at this temperature the chamber will especially not comprise liquid water.

Further, the phrase "filling gas comprising one or more of helium gas, hydrogen gas, nitrogen gas and oxygen gas (and gaseous water at 19° C.)" and similar phrases include that in embodiments the pressure within the chamber may be—at least during operation of the lamp—different from about 1 bar, such as e.g. 0.5-1.5 bar, like e.g. 0.5-1 bar, like 0.7-0.9 bar. For instance, the chamber may include the gas at a pressure of substantially more than 1 bar. However, at the pressure of the chamber and at 19° C., the chamber comprises gaseous water. Further, at this temperature and pressure the chamber will especially not comprise liquid water. The condition of "filling gas comprising one or more of helium gas, hydrogen gas, nitrogen gas and oxygen gas at 19° C." and similar conditions, such as "comprises a filling gas comprising one or more of helium gas, hydrogen gas, nitrogen gas and oxygen gas and having a relative humidity at 19° C. of at least 5% but lower than 100%" and similar phrases especially relates to the situation that the lighting device is not in operation (at 19° C.).

Hence, in a specific embodiment at least part of the assembling process is performed in said filling gas. In yet another specific embodiment, the gas is provided to said chamber after assembling the chamber with a light transmissive window, the light source and the wavelength converter, and before providing a gas closure to said chamber. In yet a further specific embodiment the filling gas is obtained after a gas closure is provided to said chamber. In the latter embodiment, one may e.g. include in the chamber a zeolite or other material that may be configured to release during part of its lifetime within the chamber water. Hence, in yet a further embodiment the chamber further comprises a material that releases water during at least part of its lifetime. Hence, the chamber may be filled with dry filling gas, and H2O may be added separately. In another embodiment, the filing gas with the indicated relative humidity is provided to the chamber (where after the chamber is closed/sealed).

The terms "upstream" and "downstream" relate to an arrangement of items or features relative to the propagation of the light from a light generating means (here the especially the first light source), wherein relative to a first position within a beam of light from the light generating means, a second position in the beam of light closer to the light generating means is "upstream", and a third position within the beam of light further away from the light generating means is "downstream".

The lighting device may be part of or may be applied in e.g. office lighting systems, household application systems, shop lighting systems, home lighting systems, accent lighting systems, spot lighting systems, theater lighting systems, fiber-optics application systems, projection systems, self-lit display systems, pixelated display systems, segmented display systems, warning sign systems, medical lighting application systems, indicator sign systems, decorative lighting systems, portable systems, automotive applications, green house lighting systems, horticulture lighting, or LCD backlighting.

As indicated above, the lighting unit may be used as backlighting unit in an LCD display device. Hence, the invention provides also a LCD display device comprising the lighting unit as defined herein, configured as backlighting unit. The invention also provides in a further aspect a liquid crystal display device comprising a back lighting unit, wherein the back lighting unit comprises one or more lighting devices as defined herein.

The term white light herein, is known to the person skilled in the art. It especially relates to light having a correlated color temperature (CCT) between about 2000 and 20000 K, especially 2700-20000 K, for general lighting especially in the range of about 2700 K and 6500 K, and for backlighting purposes especially in the range of about 7000 K and 20000 K, and especially within about 15 SDCM (standard deviation of color matching) from the BBL (black body locus), especially within about 10 SDCM from the BBL, even more especially within about 5 SDCM from the BBL.

In an embodiment, the light source may also provide light source radiation having a correlated color temperature (CCT) between about 5000 and 20000 K, e.g. direct phosphor converted LEDs (blue light emitting diode with thin layer of phosphor for e.g. obtaining of 10000 K). Hence, in a specific embodiment the light source is configured to provide light source radiation with a correlated color temperature in the range of 5000-20000 K, even more especially in the range of 6000-20000 K, such as 8000-20000 K. An advantage of the relative high color temperature may be that there may be a relative high blue component in the light source radiation.

In a specific embodiment, the light source is configured to provide blue light source radiation and the wavelength converter is configured to convert at least part of the light source radiation into wavelength converter light having one or more of a green component, a yellow component, an orange component and a red component. In this way, the lighting device may provide white light. Further, the lighting device may, in addition to the light source configured to provide excitation light to the quantum dots, also include one or more light sources, especially solid state light sources that are not primarily configured to provide radiation to the quantum dots to be wavelength converted by these quantum dots. For instance, in addition to a UV and/or blue LED, the lighting device may also include a blue and/or green and/or yellow and/or orange and/or red LED. With such lighting device, the lighting device light may further be color tuned. The term "green component" and similar terms indicate that the optical spectrum will show intensity in the green (or otherwise indicated) wavelength range.

The terms "violet light" or "violet emission" especially relates to light having a wavelength in the range of about 380-440 nm. The terms "blue light" or "blue emission" especially relates to light having a wavelength in the range of about 440-490 nm (including some violet and cyan hues). The terms "green light" or "green emission" especially relate to light having a wavelength in the range of about 490-560 nm. The terms "yellow light" or "yellow emission" especially relate to light having a wavelength in the range of about 540-570 nm. The terms "orange light" or "orange emission" especially relate to light having a wavelength in the range of about 570-600. The terms "red light" or "red emission" especially relate to light having a wavelength in the range of about 600-750 nm. The term "pink light" or "pink emission" refers to light having a blue and a red component. The terms "visible", "visible light" or "visible emission" refer to light having a wavelength in the range of about 380-750 nm.

The term "substantially" herein, such as in "substantially all light" or in "substantially consists", will be understood by the person skilled in the art. The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of". The term "and/or" especially relates to one or more of the items mentioned before and after "and/or". For instance, a phrase "item 1 and/or item 2" and similar phrases may relate to one or more of item 1 and item 2. The term "comprising" may in an embodiment refer to "consisting of" but may in another embodiment also refer to "containing at least the defined species and optionally one or more other species".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices herein are amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention further applies to a device comprising one or more of the characterizing features described in the description and/or shown in the attached drawings. The invention further pertains to a method or process comprising one or more of the characterizing features described in the description and/or shown in the attached drawings.

The various aspects discussed in this patent can be combined in order to provide additional advantages. Further, the person skilled in the art will understand that embodiments can be combined, and that also more than two embodiments can be combined. Furthermore, some of the features can form the basis for one or more divisional applications.

BRIEF DESCRIPTION OF THE DRAWINGS

Embodiments of the invention will now be described, by way of example only, with reference to the accompanying schematic drawings in which corresponding reference symbols indicate corresponding parts, and in which.

The schematic drawings are not necessarily on scale.

DETAILED DESCRIPTION OF THE EMBODIMENTS

Figure 1A:
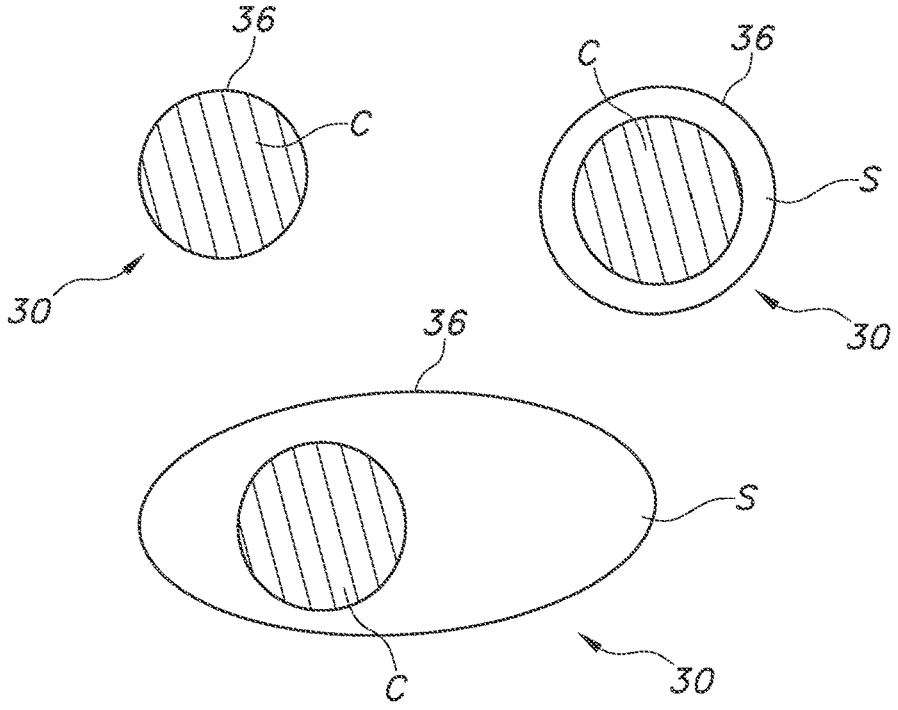
FIG. 1*a* schematically depicts an embodiment of the quantum dot based luminescent material.

FIG. 1*a* schematically depicts a quantum dot based luminescent material. By way of example different types of QDs, indicated with reference 30, are depicted. The QD at the top left is a bare QD, without shell. The QD is indicated with C (core). The QD 30 at the right top is a core-shell particle, with C again indicating the core, and S indicating the shell. At the bottom, another example of a core-shell QD is schematically depicted, but a quantum dot in rod is used as example. Reference 36 indicates the outer layer, which is in the first example the core material at the external surface, and which is in the latter two embodiments the shell material at the external surface of the QD 30.

Figure 1B:
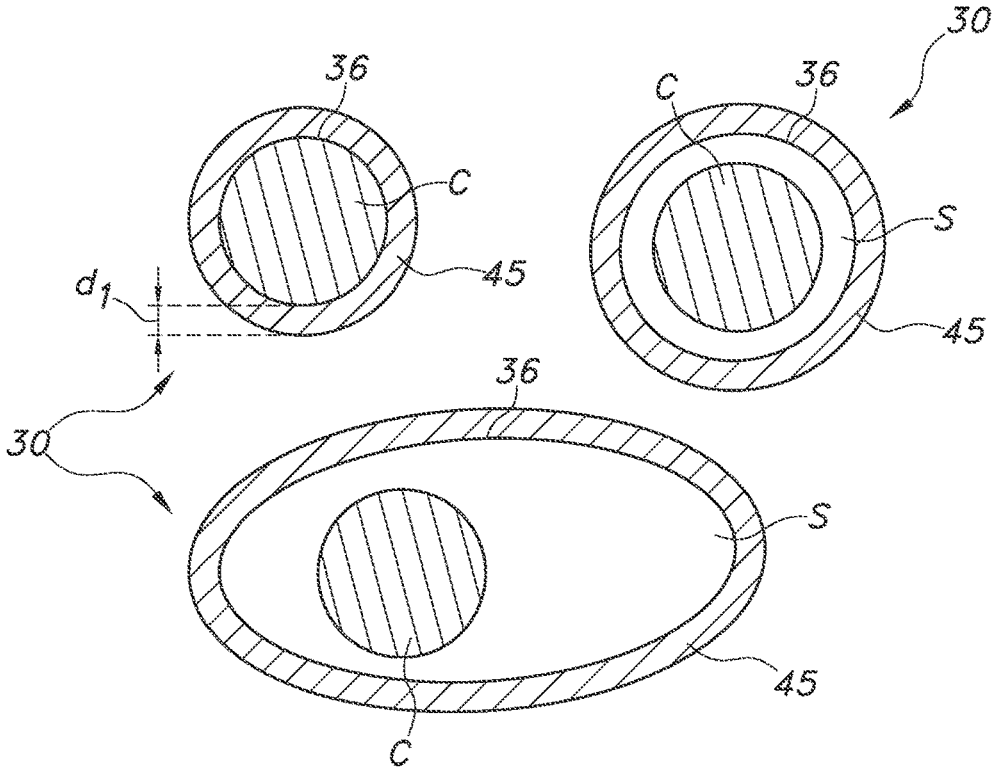
FIG. 1*b* schematically depicts an embodiment of the quantum dot based luminescent material.

FIG. 1*b* schematically depicts an embodiment of the luminescent material, but now the QDs 30 including the coating 45, especially an oxide coating, such as a silica coating. The thickness of the coating is indicated with reference d1. The thickness may especially be in the range of 1-50 nm. Especially, the coating 45 is available over the entire outer layer 36. Note however that a silica coating may be somewhat permeable. Note also that the outer layer 36 of the uncoated nanoparticle (i.e. not yet coated with the coating of the invention), is (in general) not an outer layer anymore after the coating process, as then an outer layer will be the outer layer of the coating 45. However, herein the term outer layer, especially indicated with reference 36, refers to the outer layer of the uncoated (core-shell) nanoparticle.

Figure 1C:
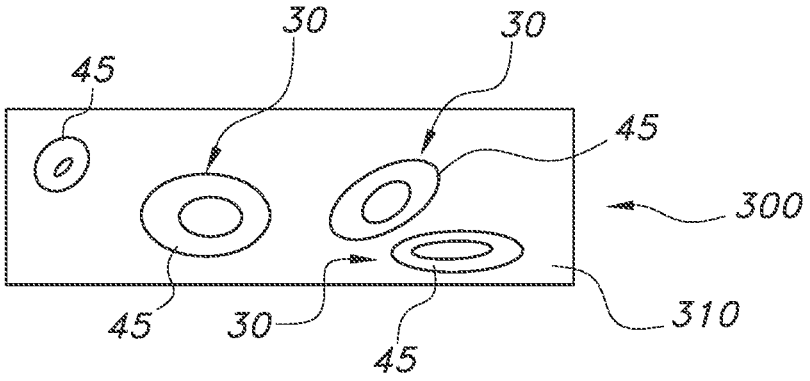
FIG. 1*c* schematically depicts an embodiment of the wavelength converter.

FIG. 1*c* schematically depicts a wavelength converter 300. Especially, the wavelength converter includes a body, such as schematically depicted here. The wavelength converter 300 comprises a matrix or matrix material 310, such as acrylate, wherein the quantum dots 30 may be embedded. By way of example, the QDs 30 include coating 45, such as a silica coating.

Figure 2A:
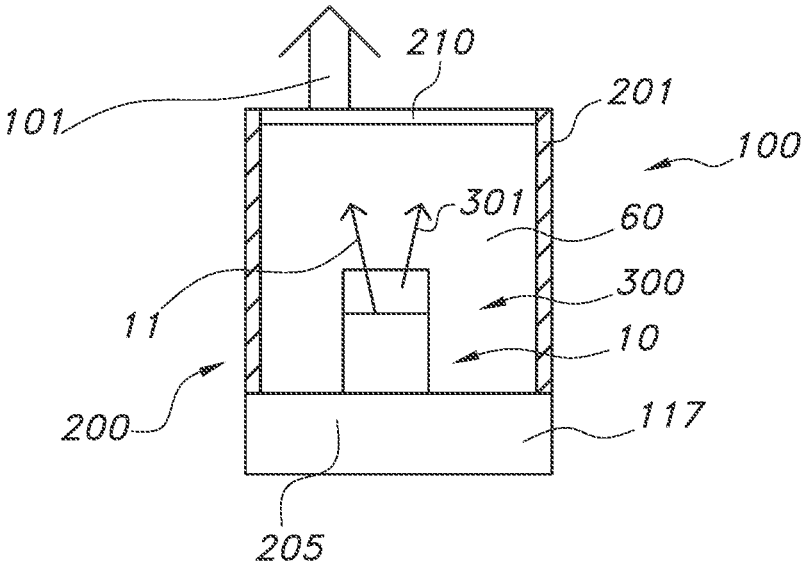
FIGS. 2*a*-2*e* schematically depicts embodiments of a lighting device.

FIG. 2*a* schematically depicts an embodiment of a lighting device 100 comprising a closed chamber 200 with a light transmissive window 210 and a light source 10 configured to provide light source radiation 11 into the chamber 200. Here, by way of example the light source 10 is also enclosed in the chamber. The chamber 200 further encloses a wavelength converter 300 configured to convert at least part of the light source radiation 11 into wavelength converter light 301. The light transmissive window 210 is transmissive for the wavelength converter light 301. The wavelength converter 300 comprises luminescent quantum dots 30 (not depicted) (as luminescent material) which upon excitation with at least part of the light source radiation 11 generate at least part of said wavelength converter light 301. Further, the closed chamber 200 comprises a filling gas 40, for instance comprising one or more of He gas, $H_2$ gas, $N_2$ gas and $O_2$ gas, and having a relative humidity at 19° C. of e.g. at least 5% but lower than 100%. Especially, at 19° C. the chamber does not include liquid water.

In this example, the wavelength converter 300 may be in physical contact of a light emitting surface of the light source 10, such as a (die of a) solid state light source.

The light source 10 is arranged on a support 205, such as a PCB. In this embodiment, the support provides part of the wall, which is indicated with reference 201. Another part of the wall 201 is provided by the light transmissive window 210. Reference 101 indicates the light generated by the lighting device 100 during operation. This lighting device at least comprises wavelength converter light 301 but may optionally also include light source radiation 11, especially when the light source 10 substantially provides light in the blue part of the spectrum. By way of example, the lighting device 100 further includes a heat sink 117. In the embodiment, the heat sink may be part of the support 205. However, the heat sink may also be arranged elsewhere. Further, the term "heat sink" may optionally also refer to a plurality if heat sinks.

Figure 2B:
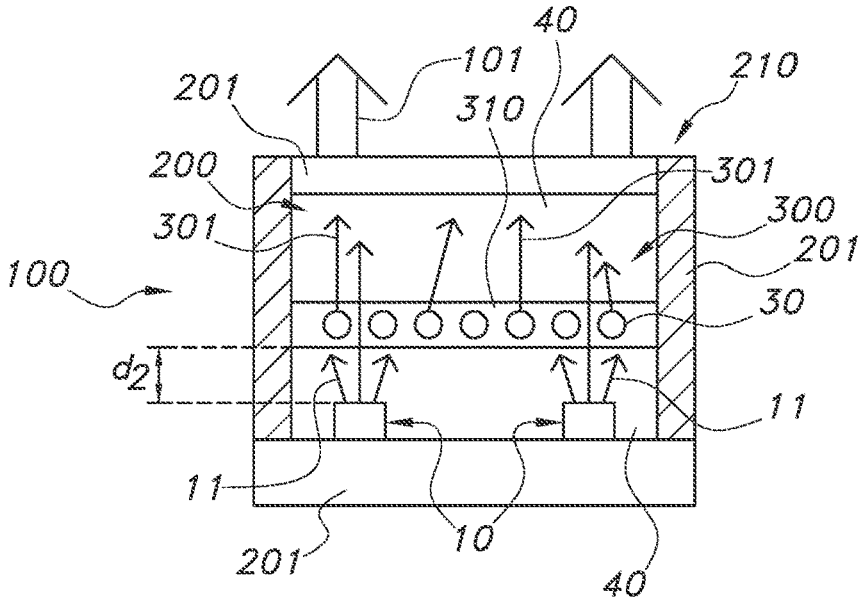
Figure 2C:
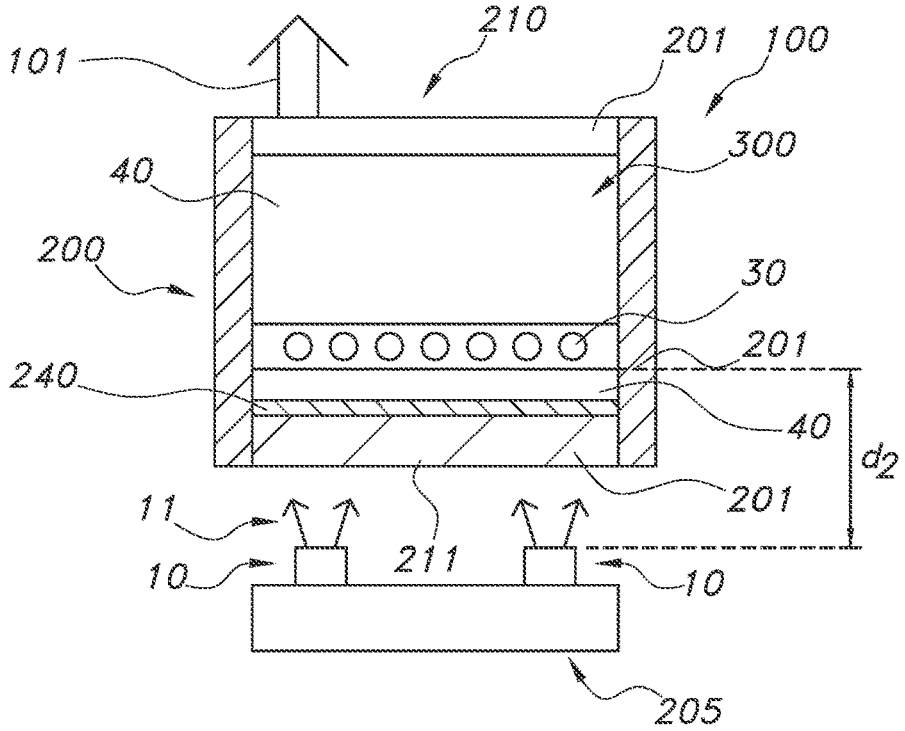

FIGS. 2*b*-2*c* schematically depict two further embodiments of the lighting device 100, with the latter having the light source 10 arranged external from the chamber. Note that in both embodiments the wavelength converter 300 is arranged at a non-zero distance from the light source 10, especially from its light emitting surface. The distance is indicated with reference d2 and may e.g. be in the range of 0.1-100 mm, such as 1-100 mm, like 2-20 mm. reference 211 in FIG. 2*c* refers to a radiation transmissive window. Note that optionally the entire wall 201 is radiation transmissive. Reference 240 refers to a material that releases water. The configuration of the water releasing material 240 in FIG. 2*c* as layer is only an example of the many options such material may be arranged.

Figure 2D:
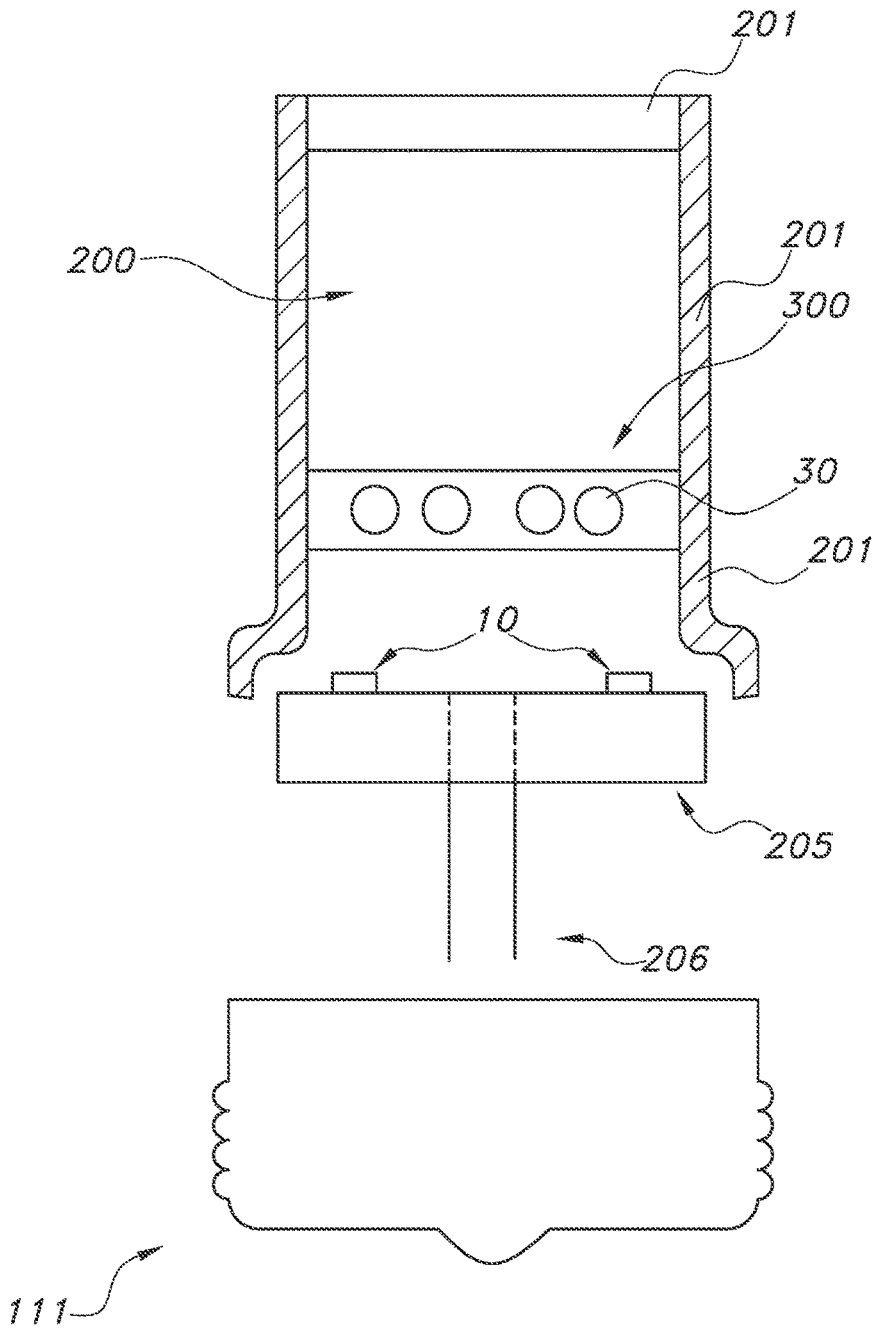
Figure 2E:
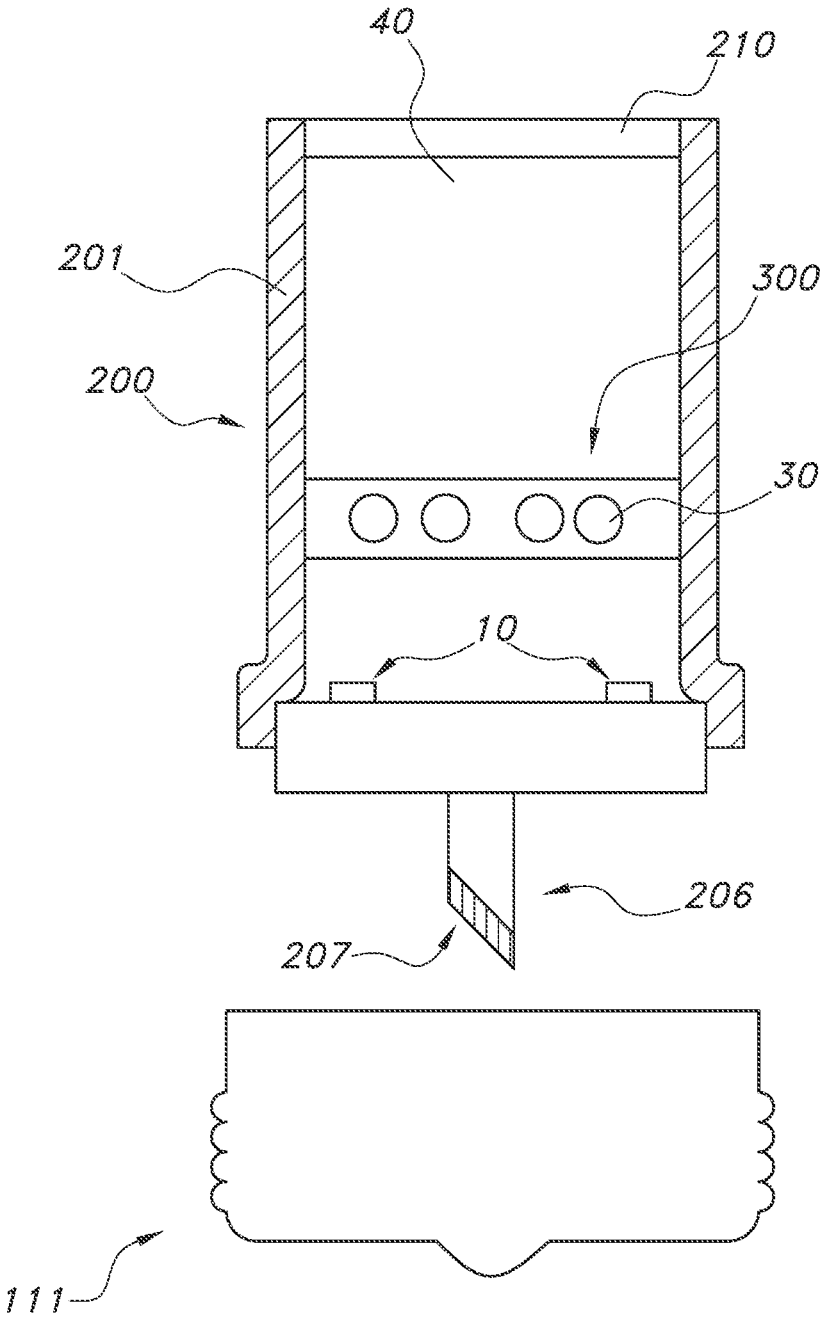

FIGS. 2*d*-2*e* schematically depict how the lighting device may be assembled. For instance, an open chamber may be provided with walls 201 and including the wavelength converter 300. This may be arranged to the light sources 10, in this embodiment arranged on the support 205 (which may optionally also include a heat sink (see above)). This may lead to a closed chamber except for an optional opening for gas. Here, a gas stem or pump stem 206 is schematically depicted. The gas may be introduced and thereafter a closure may be provided to hermetically close the chamber. An embodiment of the closure, indicated with reference 207, may be a seal, such as schematically depicted in FIG. 2*e*. Thereafter, e.g. a cap 111, such as an Edison cap, may be provided to the closed chamber. The gas, i.e. the filling gas may e.g. be provided as the filling gas with the required humidity. However, also dry filling gas may be added and water (gas or liquid) may be added from another source, leading to the filling gas in the chamber 200 having the required relative humidity.

In a further example, red emitting quantum dots consisting of a CdSe core and a ZnS shell were silica coated using the reverse micelle method as adapted by Koole et al. (see above). They were incorporated into an optical quality silicone and dropcasted onto a glass plate. The silicone was cured at 150° C. for two hours. The optical properties of the quantum dot containing film were tested at 450 nm light of an intensity of 10 W/cm$^2$ at a temperature of 100° C., detecting the intensity of the emitted light using an integrating sphere coupled to a spectrophotometer.

Figure 3:
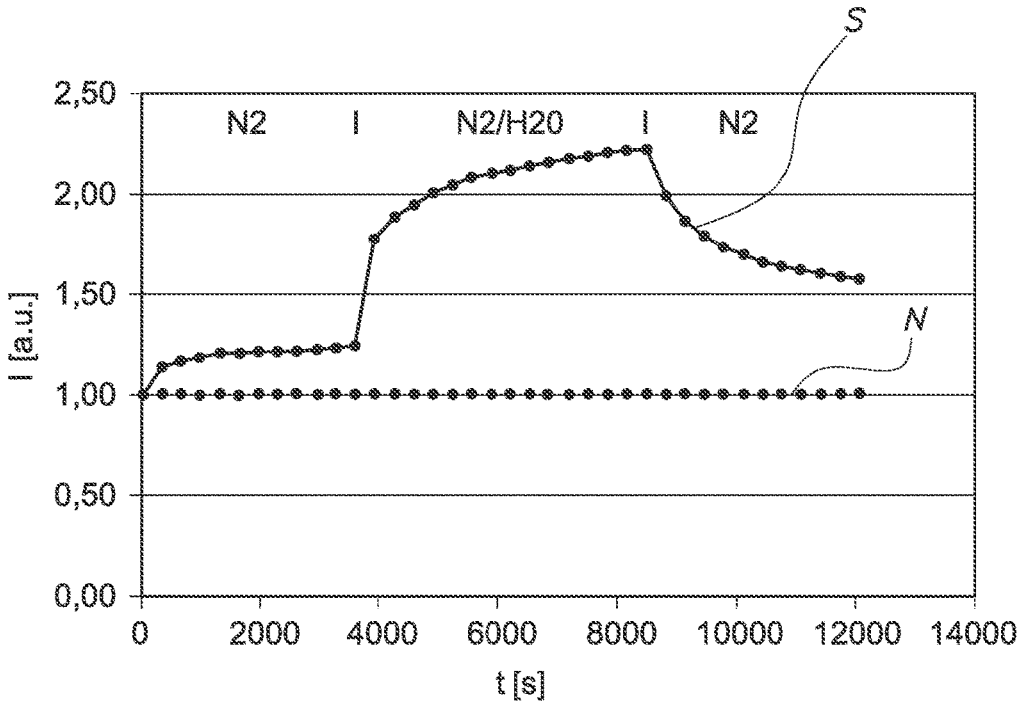
FIG. 3 shows an experiment wherein the influence of water is tested.

A stream of dry nitrogen was flown over the sample for one hour, slight photobrightening occurred in this time frame. Subsequently the flow was switched to humidified nitrogen which led to an increase in the photoluminescence with about a factor 2. Switching back to dry nitrogen, 90 minutes later, showed a strong decrease in photoluminescence. This result demonstrates that these silica coated quantum dots need water for optimal luminescence. These data are depicted in FIG. 3, with on the x-axis time in seconds and on the y-axis the integrated intensity in arbitrary units. The dotted line (N) at intensity 1 indicates the normalized transmitted laser intensity, and the curve (S) indicates the normalized corrected photoluminescence.

In a second embodiment, silica coated QDs (peak maximum of ~610 nm at room temperature) were mixed into commercial silicone. YAG:Ce powder was added to the QD-silicone mixture, and this blend was dispensed into LED packages, after which the phosphor-silicone blend was cured for 2 hours at 150 C. The concentration of QDs and YAG:Ce material was tuned in order to achieve a color temperature of 2700 K-3000 K (close to or on the black body line), and high CRI (80, 85, 90, or higher).

In a third embodiment, LEDs as described in the second embodiment are placed on metal core (MC) PCB's by solder attach, and mounted inside a glass bulb in a process similar to that used to build conventional incandescent light bulbs. The glass bulb allows for hermetic sealing, and prior to sealing the atmosphere within the bulb can be adjusted. Electrical connection to the LED is still possible by metal wires through the glass (as is also done for conventional glass bulbs). Each glass bulb contains 1 LED, and various bulbs were sealed at 950 mbar pressure of air. The relative humidity of the air with which the bulb was filled was varied by using a well-controlled mixture of dry (10 ppmV) and water-saturated air, making use of mass flow controllers. In this way, bulbs were filled with relative humidity's (RH) (at room temperature) of 0% (actually 0.05-0.25%), 1%, 10%, and 80%. The gas content of a few test bulbs was analyzed which confirmed the control over humidity within the sealed glass bulb (see further also below the data in the table).

The LEDs within sealed glass bulbs with various humidity levels were tested on stability, by measuring the light output and spectra of the lamp at fixed time intervals. The spectra were recorded prior to sealing/filling, after sealing/filling, and subsequently the LEDs were driven continuously at $I_F$=150 mA ($V_F$=~6 V). It was found that the QDs are at an average temperature of approximately 85° C. under these drive conditions. At fixed intervals the LEDs were switched off to measure the light output and spectra off line, thereafter they were remounted and switched on again at the same drive current setting.

Using the 1960 CIE color diagram, u' is the appropriate parameter to follow the QD emission over time because the QDs emit at around 610-620 nm. A shift in u' larger than 0.007 over the LED lifespan is generally considered to be not acceptable. Upon sealing (so without turning on/off the LED), it is observed that the LEDs enclosed under dry conditions (0%, and 1% RH) show a significant drop in u' (i.e. loss in QD emission). The LED sealed under 10% RH shows a moderate drop in u', and the LED in 80% RH shows an increase in u', similar to the LED that was not sealed (i.e. ambient conditions). A control LED without QDs which was also sealed at 80% RH did not show any changes upon sealing. Next, when the LEDs are driven at 150 mA, a significant further drop is observed for the LEDs under dry conditions (0%, 1% RH), and the 10% RH LED shows a further moderate drop. The 80% RH and open LED show a further increase in u', albeit small. After the 50 h data point, it is observed that the 0%, 1%, and 10% RH LEDs recover (albeit partly) from the initial drop, until 500 h, after which it stabilizes and decays after 1000 h and further. The LEDs at 80% RH and open condition show fairly stable behavior from 50 h and further. The reference LED without QDs at 80% RH shows no significant changes, which pinpoints that the observed effects are QD related.

The data show that 0% is not wanted and 1% is less desirable, 80% is the same as open, and that in the order of about 5-10% RH is a critical filling value for these lamps. In general, the lower value may be 5% RH but this may depend upon the lamp type and pressure. Hence, the value of at least 1% is chosen, even more especially at least 5%, such as at least 10%.

The above examples show that silica coated QDs require a controlled amount of water in their environment for optimal performance. Under dry conditions (0%, 1%, and 10% to a certain extent) a significant initial drop and recovery in QD emission is observed which is not desired in view of constant light output, CRI, and CCT over time. At 80% RH these effects are not observed. Therefore it is disclosed here that in case QD-LEDs are sealed, a controlled amount of water should be enclosed, preferably above 10%, and below 100%. The upper limit of 80-90% is in view of water condensation that could occur at lower temperature that may result in unwanted side-effects on the electronics (eg shorts), or an undesired visual appearance of droplets.

During sealing of glass bulbs using the conventional process in a production line, the melting of the stem into the bulb and the actual sealing of the bulb is done consecutively, on one and the same line.

In an embodiment, one may add silica powders within the LED bulb (e.g. for making a "frosted" LED bulb) that adsorb/absorb excess of water to avoid condensation of water at eg the LED (in view of shorts). This could also allow for higher than 100% RH (at RT) water enclosure if desired. At the same time, the silica may act as "getter" for water, so effectively take away water from the QDs. In that case, higher (initial) loading with water may be needed. In summary, when silica powder is added to the bulb, the (initial) optimal water concentration may be beyond the 10%-80% RH at RT. Silica powder, or other powder used, to make a bulb "frosted" may take up water. This will reduce the RH and hence affect the QD quantum efficiency. This would require to include more water than anticipated, because the silica will take up (significant amounts of) water and the RH will drop. The final RH in the bulb after the moisture level in the silica has equilibrated should still be >10% RH. Silica powder and/or other powders like titania, may be provided as coating at the internal surface of at least part of the wall(s) of the chamber, especially the light transmissive part, to provide a frosted appearance.

A further example was executed with other LEDs and supports (see table below). Substantially the same type of LEDs and QD-YAG:Ce phosphor mixture were used, and again the LEDs were enclosed in substantially the same type of glass bulbs under various RH (at room temperature): 0%, 1%, 10% and 80%. For reference, one glass bulb containing a QD-LED was not sealed ("open"), and one LED without QDs was sealed under 80% humidity ("ref LED").The operation temperatures were between 80-120° C. The same tests were performed with different components, and the same trend was found. Below, one of the series of test data is provided. This table indicates delta u' as function of time (in hours) for LEDs enclosed in a glass bulb under various relative humidities at room temperature:

| | | Time (h) | | | | | | | |
|---|---|---|---|---|---|---|---|---|---|
| | filling | −50 | 0 | 41 | 200 | 500 | 1000 | 2000 | 3000 |
| ref LED | 80% RH | 0 | 0 | −0.0004 | −0.0005 | −0.0007 | −0.0007 | −1E−04 | −0.0007 |
| 1 | open | 0 | 0.0007 | 0.0033 | 0.0029 | 0.0032 | 0.0026 | −0.0019 | −0.0068 |
| 2 | open | 0 | 0.0015 | 0.0031 | 0.0026 | 0.0032 | 0.0017 | −0.0031 | −0.0079 |
| 3 | 0% RH | 0 | −0.0119 | −0.0211 | −0.0117 | −0.0083 | −0.008 | −0.0111 | −0.015 |
| 4 | 0% RH | 0 | −0.0114 | −0.0192 | −0.0131 | −0.0073 | −0.0056 | −0.0058 | −0.0076 |
| 5 | 0% RH | 0 | −0.0117 | −0.0196 | −0.0106 | −0.0043 | −0.0043 | −0.0065 | −0.0101 |
| 6 | 1% RH | 0 | −0.0113 | −0.0216 | −0.0103 | −0.0029 | −0.0041 | −0.013 | −0.0218 |
| 7 | 1% RH | 0 | −0.0075 | −0.0177 | −0.0097 | −0.0055 | −0.0058 | −0.0081 | −0.011 |
| 8 | 10% RH | 0 | −0.001 | −0.0028 | 0.0003 | 0.0026 | 0.0012 | −0.0036 | −0.0091 |
| 9 | 10% RH | 0 | −0.0035 | −0.0113 | −0.0055 | −0.0019 | −0.0024 | −0.006 | −0.0102 |
| 10 | 80% RH | 0 | 0.0026 | 0.0047 | 0.0037 | 0.0038 | 0.0028 | −0.0024 | −0.0082 |
| 11 | 80% RH | 0 | 0.0028 | 0.004 | 0.0033 | 0.0037 | 0.0026 | −0.0029 | −0.0086 |

The measurement at −50 h is a measurement before filling and sealing; i.e. a measurement in ambient air. Filling and sealing (melting pump stem) is done at 0 h, where after the 0 h measurement (and the other measurements) are done.

In a further example, red emitting quantum dots consisting of a CdSe core and a ZnS shell were silica coated using the reverse micelle method as adapted by Koole et al. (see above). They were incorporated into an optical quality silicone and dropcasted onto a glass plate. The silicone was cured at 150° C. for two hours. The optical properties of the quantum dot containing film were tested at 450 nm light of an intensity of 10 W/cm$^2$ at a temperature of 100° C., detecting the intensity of the emitted light using an integrating sphere coupled to a spectrophotometer.

All Relative Humidities mentioned in the document are relative humidities at room temperature (19° C.). For example, 80% RH at 19° C. equals 1.77 vol % $H_2O$.

Karl Fischer experiments, as known in the art, were used to measure relative humidities of gasses in light bulbs. Fight bulbs filled with water/gas mixtures were analyzed using a specific method for the analysis of water. The bulb is positioned in a cracker purged with dry nitrogen. The nitrogen purge gas is fed into a water detector based on a Karl-Fisher titration. After several blank runs (each lasting 15 minutes) the bulb is cracked and the water released is swept into the water detector for analysis.

The invention claimed is:

1. A lighting device comprising (i) a closed chamber with a light transmissive window; and (ii) a light source configured to provide light source radiation into the chamber, wherein the chamber further encloses a wavelength converter configured to convert at least part of the light source radiation into wavelength converter light, wherein the light transmissive window is transmissive for the wavelength converter light, wherein the wavelength converter comprises luminescent quantum dots which upon excitation with at least part of the light source radiation generate at least part of the wavelength converter light, wherein the closed chamber comprises a filling gas comprising one or more of helium gas, hydrogen gas, nitrogen gas, and oxygen gas, the filling gas having a relative humidity at 19° C. of at least 5%, wherein at least 80% of the filling gas consists of He, and wherein the chamber does not comprise liquid water at 19° C.

2. The lighting device according to claim 1, wherein the wavelength converter comprises a siloxane matrix, wherein the luminescent quantum dots are embedded in the siloxane matrix.

3. The lighting device according to claim 1, wherein the luminescent quantum dots comprise an inorganic coating.

4. The lighting device according to claim 1, wherein the closed chamber comprises a light bulb shaped light transmissive window.

5. The lighting device according to claim 1, wherein the light source is configured to provide blue light source radiation and wherein the wavelength converter is configured to convert at least part of the light source radiation into wavelength converter light having one or more of a green component, a yellow component, an orange component, and a red component.

6. The lighting device according to claim 1, wherein the light source comprises a solid state light source.

7. The lighting device according to claim 1, further comprising a heat sink in thermal contact with at least one of the transmissive window, the light source, and the wavelength converter.

8. A consumer lighting system, comprising the lighting device of claim 1.

9. A lighting device, comprising (i) a closed chamber with a light transmissive window; and (ii) a light source configured to provide light source radiation into the chamber, wherein the chamber further encloses a wavelength converter configured to convert at least part of the light source radiation into wavelength converter light, wherein the light transmissive window is transmissive for the wavelength converter light, wherein the wavelength converter comprises luminescent quantum dots which upon excitation with at least part of the light source radiation generate at least part of the wavelength converter light, wherein the closed chamber comprises a filling gas comprising one or more of helium gas, hydrogen gas, nitrogen gas, and oxygen gas, the filling gas having a relative humidity at 19° C. of at least 5%, wherein at least 95% of the filling gas consists of He and $O_2$, and wherein the gas comprises at most 25% oxygen.

10. The lighting device according to claim 9, wherein the wavelength converter comprises a siloxane matrix, wherein the luminescent quantum dots are embedded in the siloxane matrix.

11. The lighting device according to claim 9, wherein the luminescent quantum dots comprise an inorganic coating.

12. The lighting device according to claim 9, wherein the closed chamber comprises a light bulb shaped light transmissive window.

13. The lighting device according to claim 9, wherein the light source is configured to provide blue light source radiation and wherein the wavelength converter configured to convert at least part of the light source radiation into wavelength converter light having one or more of a green component, a yellow component, an orange component, and a red component.

14. The lighting device according to claim 9, wherein the light source comprises a solid state light source.

15. The lighting device according to claim 9, further comprising a heat sink in thermal contact with at least one of the transmissive window, the light source, and the wavelength converter.

16. A consumer lighting system, comprising the lighting device of claim 9.

17. A process for production of a lighting device comprising a closed chamber with a light transmissive window and a light source configured to provide light source radiation into the chamber, wherein the chamber further encloses a wavelength converter configured to convert at least part of the light source radiation into wavelength converter light, wherein the light transmissive window is transmissive for the wavelength converter light, wherein the wavelength converter comprises luminescent quantum dots which upon excitation with at least part of the light source radiation generate at least part of the wavelength converter light, and wherein the closed chamber comprises a filling gas comprising one or more of helium gas, hydrogen gas, nitrogen gas, and oxygen gas, the filling gas having a relative humidity at 19° C. of at least 1%, the process comprising assembling the chamber with the light transmissive window, the light source, and the wavelength converter, wherein the filling gas and water are provided to the chamber, wherein the filling gas is obtained after a gas closure is provided to the chamber, and wherein the chamber further comprises a material that releases water during at least part of its lifetime.

18. The process according to claim 17, wherein the wavelength converter comprises a siloxane matrix, wherein the luminescent quantum dots are embedded in the siloxane matrix.

19. The process according to claim 17, wherein the luminescent quantum dots comprise an inorganic coating or a silica coating.

20. The process according to claim 17, wherein at least 80% of the filling gas consists of He, the filling gas having a relative humidity at 19° C. of at least 5%, and wherein the chamber does not comprise liquid water at 19° C.

21. The process according to claim 17, wherein at least 95% of the filling gas consists of He and $O_2$, and wherein the gas comprises at most 25% oxygen.

22. The process according to claim 17, wherein the closed chamber comprises a light bulb shaped light transmissive window.

23. The process according to claim 17, wherein the light source is configured to provide blue light source radiation and wherein the wavelength converter is configured to convert at least part of the light source radiation into wavelength converter light having one or more of a green component, a yellow component, an orange component, and a red component.

24. The process according to claim 17, further comprising disposing a heat sink in thermal contact with at least one of the transmissive window, the light source, and the wavelength converter.

25. The process according to claim 17, wherein material that releases water is a zeolite.

* * * * *